US006318822B1

(12) United States Patent
Wang

(10) Patent No.: US 6,318,822 B1
(45) Date of Patent: Nov. 20, 2001

(54) CLOTHES CABINET FOR WARDROBE

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/664,709

(22) Filed: Sep. 19, 2000

(51) Int. Cl.[7] ..... F16B 12/10; A47B 87/02
(52) U.S. Cl. ..... 312/111; 312/107; 108/149
(58) Field of Search ..... 312/107, 108, 312/111, 4, 245, 257.1; 108/149, 164; 211/189, 194, 113, 126.2, 126.7, 126.12

(56) References Cited

U.S. PATENT DOCUMENTS 1,573,608 * 2/1926 Huffman ..... 312/107
2,410,700 * 11/1946 Zalkind ..... 312/111
2,845,185 * 7/1958 Winderweedle, Jr. ..... 108/149 X
4,169,639 * 10/1979 Zola ..... 312/111 X
4,239,306 * 12/1980 Klaus ..... 312/108 X

* cited by examiner

*Primary Examiner*—Peter M. Cuomo
*Assistant Examiner*—James O. Hansen
(74) *Attorney, Agent, or Firm*—A & J

(57) ABSTRACT

A clothes cabinet adapted for mounting in a wardrobe, the clothes cabinet including a plurality of individual boxes, and at least one coupling wire rod adapted to secure the individual boxes in a stack, the individual boxes each having two vertical side panels, a horizontal bottom panel, a horizontal top panel, and a plurality of upper peripheral barrels and lower peripheral barrels horizontally aligned along top and bottom sides of the respective two vertical side panels, the at least one coupling wire rod each having a curved middle section attached to the horizontal top panel of one individual box at a bottom side, and two end rod sections respectively perpendicularly extended from two distal ends of the curved middle section and inserted into the lower peripheral barrels of one of the individual boxes and the upper peripheral barrels of a second of the individual boxes.

5 Claims, 4 Drawing Sheets

CLOTHES CABINET FOR WARDROBE

BACKGROUND OF THE INVENTION

The present invention relates to wardrobes, and more specifically to a clothes cabinet for wardrobe, which is comprised of a plurality of individual boxes connected in series by coupling wire rods.

Flexible clothes containers or clothes cabinets may be used in wardrobes to hold classified clothes. Various support frame structures have been disclosed for use to hold flexible clothes containers in wardrobes. A regular support frame structure for this purpose is known comprised of a support frame adapted to support a flexible clothes container in shape, and hooks mounted on the support frame and extended out of the flexible clothes container for hanging on a rod member in a wardrobe. This design of support frame structure has numerous drawbacks. After installation of the support frame structure in a flexible clothes container, dust may pass to the inside of the flexible clothes container through the gaps between the top panel of the flexible clothes container and the hooks. Because the support frame simply extends along the border area of the top panel of the flexible clothes container, the support frame structure cannot positively support the top panel of the flexible clothes container against deformation. The complicated support frame also complicates the assembly process of the support frame structure. Further, regular clothes containers and clothes cabinets cannot be adjusted to change the height and holding space subject to the volume of clothes to be held.

SUMMARY OF THE INVENTION

The present invention has been accomplished to provide a clothes cabinet for wardrobe, which eliminates the aforesaid drawbacks. It is one object of the present invention to provide a clothes cabinet for wardrobe, which can be conveniently adjusted subject to the volume of clothes to be held. It is another object of the present invention to provide a clothes cabinet for wardrobe, which does not deform easily when supporting a heavy load. It is still another object of the present invention to provide a clothes cabinet, which is durable in use. To achieve these and other objects of the present invention and according to one aspect of the present invention, the clothes cabinet for wardrobe is comprised of a plurality of individual boxes, and at least one coupling wire rod adapted to secure the individual boxes in a stack. The individual boxes each comprise two vertical side panels, a horizontal bottom panel, a horizontal top panel, and a plurality of upper peripheral barrels and lower peripheral barrels horizontally aligned along top and bottom sides of the respective two vertical side panels. The at least one coupling wire rod each comprises a curved middle section attached to the horizontal top panel of one individual box at a bottom side, and two end rod sections respectively perpendicularly extended from two distal ends of the curved middle section and inserted into the lower peripheral barrels of one of the individual boxes and the upper peripheral barrels of a second of the individual boxes. According to another aspect of the present invention, a stretcher frame is press-fitted into the top individual box and closely attached to the horizontal top panel of the top individual box to support the top individual box in shape, and a hanging rod is inserted through top barrels at the top side of the horizontal top panel of the top individual box, and adapted to suspend the clothes cabinet inside of a wardrobe.

DETAILED DESCRIPTION OF THE PREFERRED EMBODIMENT

Figure 1:
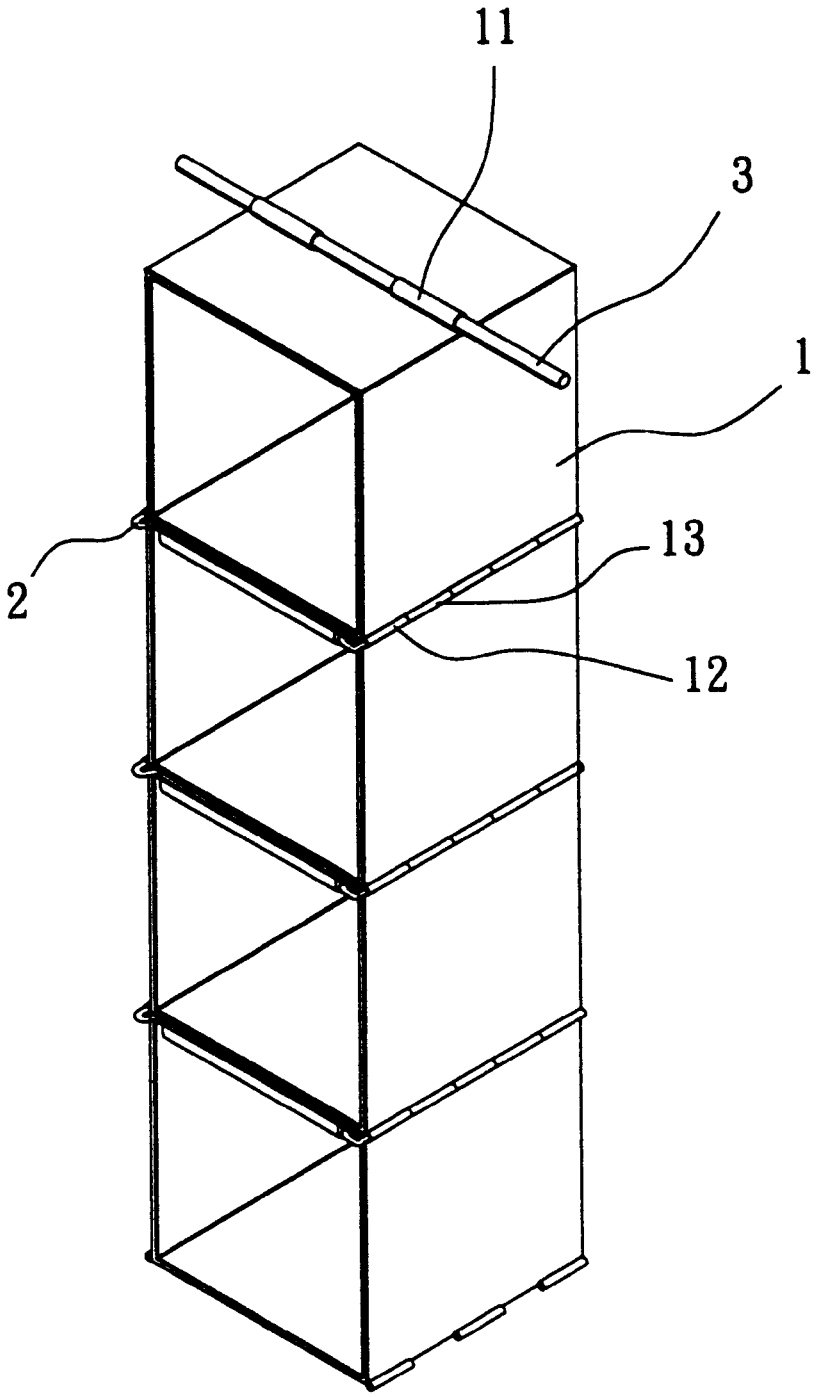
FIG. 1 is an elevational view of a clothes cabinet constructed according to the present invention.

Referring to FIG. 1, a clothes cabinet mounting arrangement for wardrobe in accordance with the present invention is generally comprised of a plurality of individual boxes 1 connected in series and arranged in a stack.

Figure 4:
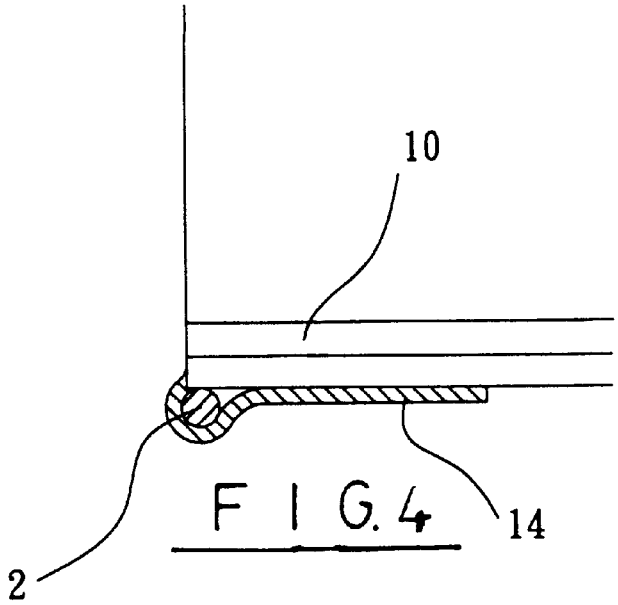
FIG. 4 is a sectional view in an enlarged scale taken along line A—A of FIG. 3.
Figure 5:
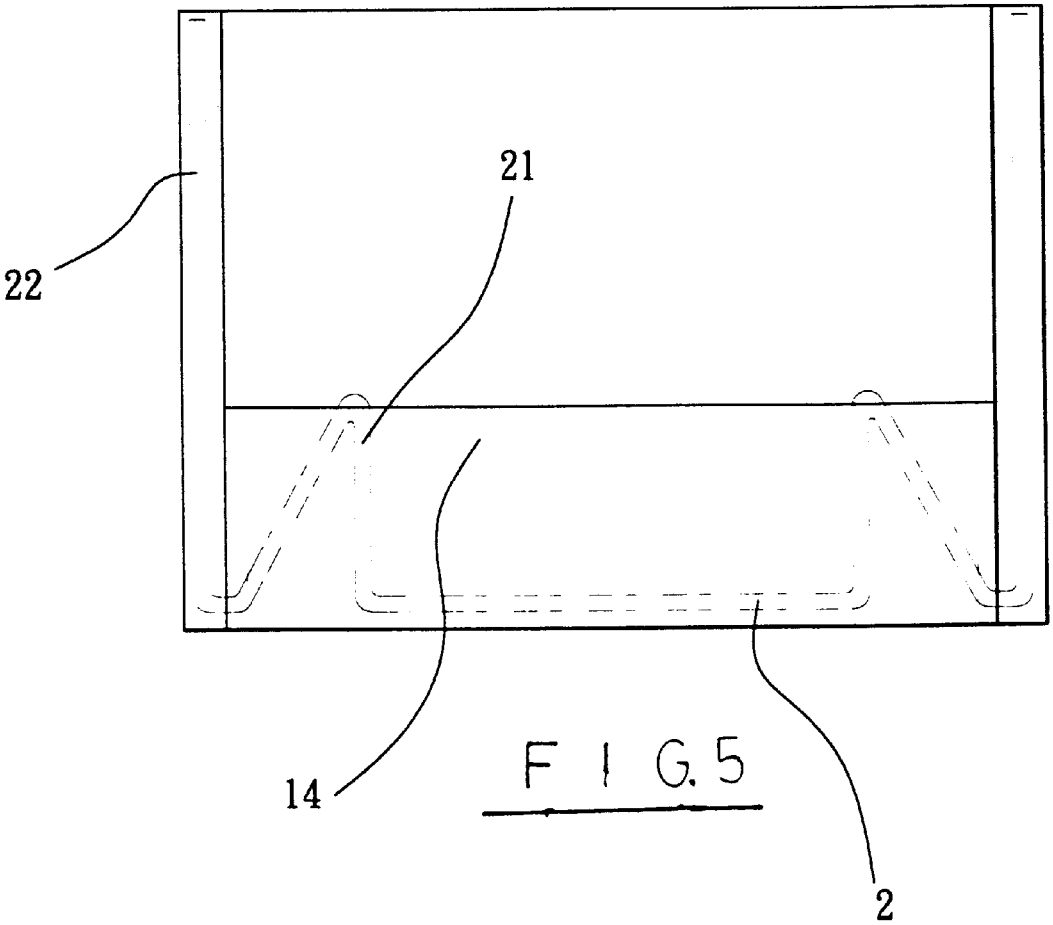
FIG. 5 is a top plain view in an enlarged scale of a part of the clothes cabinet shown FIG. 1, showing the curved middle section of the coupling wire rod secured to the cover flap.

Referring to FIGS. from 2 through 5 and FIG. 1 again, the top one of the individual boxes 1 comprises two top barrels 11 horizontally aligned in X-axis direction at the top of the horizontal top panel thereof, and a plurality of lower peripheral barrels 13 horizontally aligned in Y-axis direction along the bottom of the two vertical side panels thereof. The other individual boxes 1 each comprise a plurality of upper peripheral barrels 12 and a plurality of lower peripheral barrels 13 horizontally aligned in Y-axis direction along the top and bottom of the respective two vertical side panels, and a cover flap 14 fastened to the bottom sidewall of the horizontal top panel along the front side. The cover flap 14 is an elongated fabric strip having two distal ends fixedly fastened to the horizontal top panel of the corresponding individual box 1. After two individual boxes 1 had been attached together in a stack, the lower peripheral barrels 13 of the upper individual box 1 are respectively connected in between the upper peripheral barrels 12 of the other, and a coupling wire rod 2 is fastened to the lower peripheral barrels 13 of the upper individual box and the upper peripheral barrels 12 of the lower individual box to secure the two individual boxes together. The coupling wire rod 2 comprises a curved middle section 21, and two parallel end rod sections 22 respectively perpendicularly extended from the two distal ends of the curved middle section 21 and adapted for inserting into the lower peripheral barrels 13 of the upper individual box and the upper peripheral barrels 12 of the lower individual box. After installation of one coupling wire rod 2 in the respective barrels 12 and 13 of two individual boxes 1, the protruded portions of the curved middle section 21 of the coupling wire rod 2 are inserted in between the cover flap 14 and horizontal top panel of the lower individual box to support the horizontal bottom panel 10 of the upper individual box (see FIGS. 4 and 5).

Figure 2:
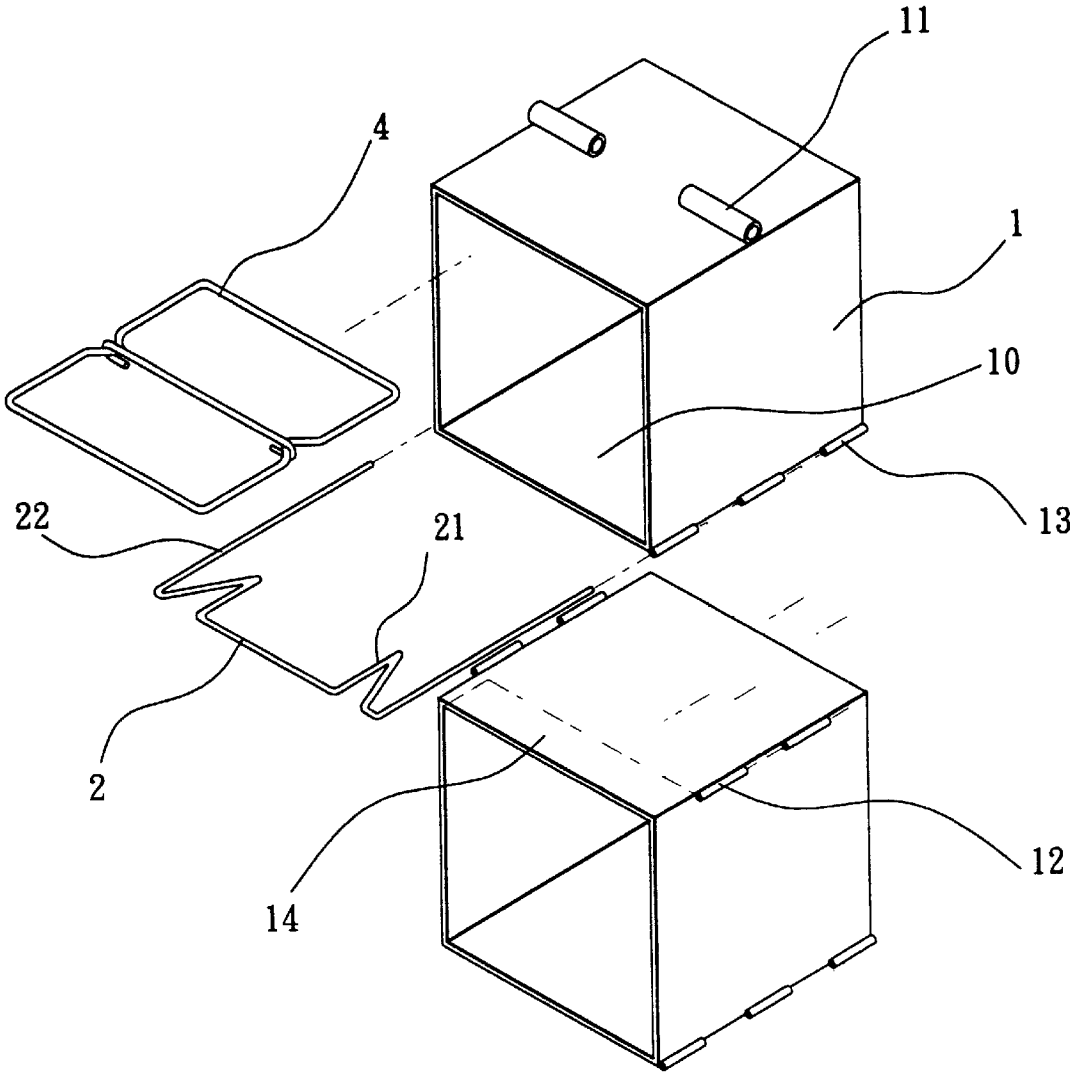
FIG. 2 is an exploded view in an enlarged scale of a part of the clothes cabinet shown in FIG. 1.

Referring to FIGS. 1 and 2 again, after the individual boxes 1 had been connected in a stack, a stretcher frame 4 is press-fitted into the top individual box and closely attached to the horizontal top panel of the top individual box to support the top individual box in shape, and a hanging rod 3 is inserted through the top barrels 11 of the top individual box and fastened to the inside of the wardrobe (not shown) to suspend the series of individual boxes 1 in the wardrobe. If only the top individual box is used, one coupling wire rod 2 is fastened to the lower peripheral barrels 13 of the top individual box 1 to support the lower part of the top individual box in shape.

Figure 3:
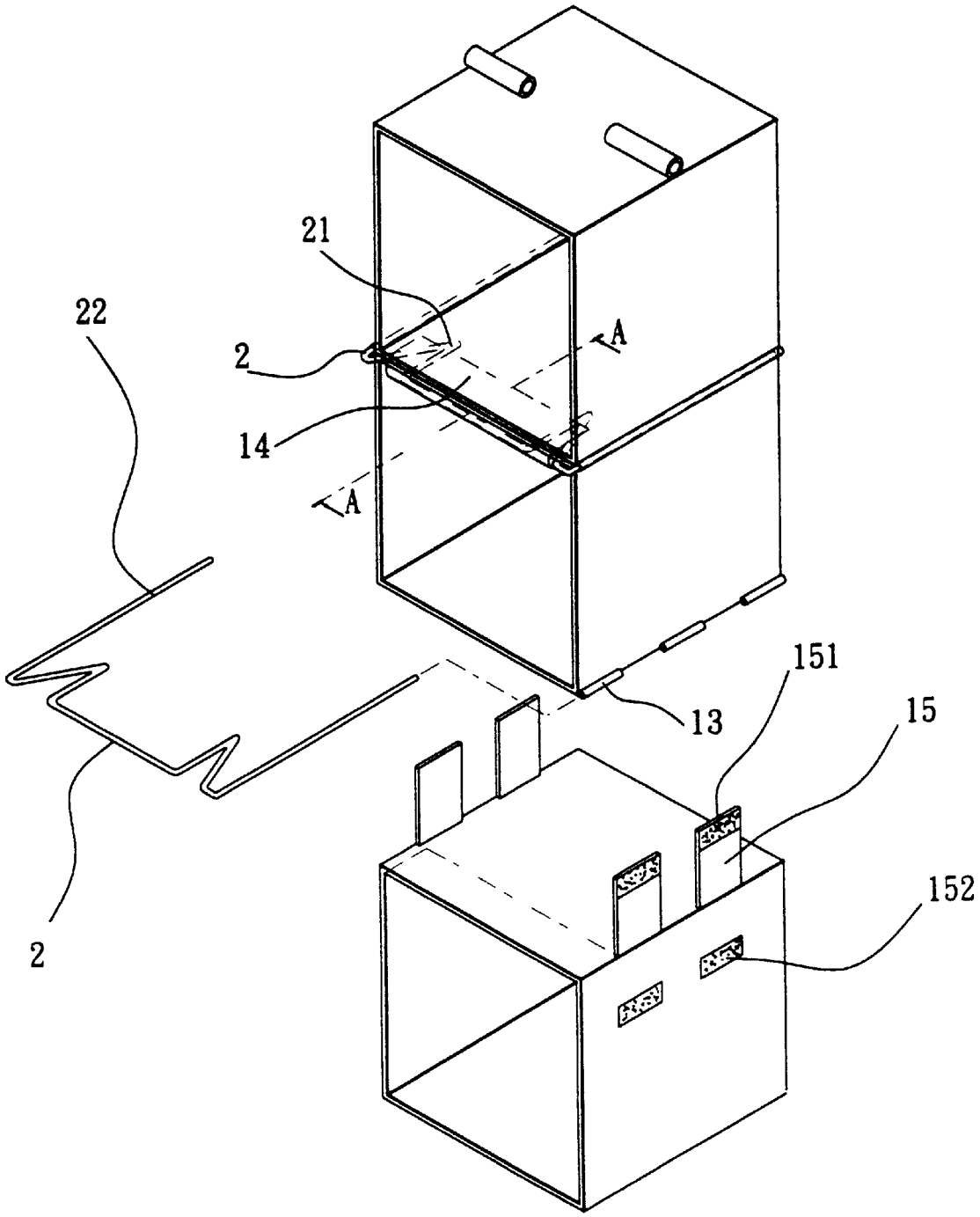
FIG. 3 is an exploded view of an alternate form of the present invention.

Referring to FIG. 3 again, as an alternate form of the present invention, fastening devices 15 may be used instead of the upper peripheral barrels 12. The fastening devices 15 each are comprised of a tape of hook material 151, and a tape of loop material 152. After the end rod sections 22 had been inserted into the lower peripheral barrels 13 of one individual box, the tapes of hook material 151 of the lower individual box are respectively covered over the end rod sections 22 and secured to the respective tapes of loop material 152 to secure the lower individual box to the upper individual box.

It is to be understood that the drawings are designed for purposes of illustration only, and are not intended for use as a definition of the limits and scope of the invention disclosed.

What the invention claimed is:

1. A clothes cabinet adapted for mounting in a wardrobe, the clothes cabinet comprising a plurality of individual boxes, and at least one coupling wire rod adapted to secure said individual boxes in a stack, said individual boxes each comprising two vertical side panels, a horizontal bottom panel, a horizontal top panel, and a plurality of upper peripheral barrels and lower peripheral barrels horizontally aligned along top and bottom sides of the respective two vertical side panels, said at least one coupling wire rod each comprising a curved middle section attached to the horizontal top panel of one individual box at a bottom side, and two end rod sections respectively perpendicularly extended from two distal ends of said curved middle section and inserted into the lower peripheral barrels of one of said individual boxes and the upper peripheral barrels of a second of said individual boxes.

2. The clothes cabinet of claim 1 wherein said individual boxes each further comprise a cover flap fastened to the respective horizontal top panel and adapted to hold the curved middle section of one of said at least one coupling wire rod.

3. The clothes cabinet of claim 2 wherein said cover flap has two distal ends respectively fixedly fastened to a bottom surface of the horizontal top panel of the corresponding individual box.

4. A clothes cabinet adapted for mounting in a wardrobe, the clothes cabinet comprising a plurality of individual boxes, and at least one coupling wire rod adapted to secure said individual boxes in a stack, said individual boxes each comprising two vertical side panels, a horizontal bottom panel, a horizontal top panel, a plurality of peripheral barrels respectively horizontally aligned along the lowest edge of the respective two vertical side panels, and a plurality of fastening devices disposed along the topmost edge of the respective two vertical side panels, said at least one coupling wire rod each comprising a curved middle section attached to the horizontal top panel of one individual box at a bottom side, and two end rod sections respectively perpendicularly extended from two distal ends of said curved middle section and inserted into the peripheral barrels of one of said individual boxes and fastened to the fastening devices of a second of said individual boxes.

5. The clothes cabinet of claim 4 wherein said fastening devices each comprise a tape of hook material and a tape of loop material.

* * * * *